United States Patent [19]

Hockett

[11] Patent Number: 4,895,451

[45] Date of Patent: Jan. 23, 1990

[54] MIXING DEVICE

[75] Inventor: Wayne B. Hockett, Tampa, Fla.

[73] Assignee: Continuous Hose Corporation, Tampa, Fla.

[21] Appl. No.: 215,001

[22] Filed: Jul. 5, 1988

[51] Int. Cl.[4] ..... B01F 15/02

[52] U.S. Cl. ..... 366/150; 366/3; 366/10; 239/433

[58] Field of Search ..... 366/3, 5, 11, 10, 150, 366/163, 165, 167, 173, 176; 239/433; 51/410, 427, 428, 439

[56] References Cited

U.S. PATENT DOCUMENTS

| | | | |
|---|---|---|---|
| 2,075,867 | 4/1937 | Sampel | 366/11 |
| 2,231,489 | 2/1941 | Anderson | 366/11 |
| 2,453,465 | 11/1948 | Sloan | 366/163 |
| 4,264,212 | 4/1981 | Tookey | 239/433 |
| 4,796,814 | 1/1989 | Klemm | 239/433 |

*Primary Examiner*—Robert W. Jenkins
*Attorney, Agent, or Firm*—Frijouf, Rust & Pyle

[57] ABSTRACT

An improved mixing device is disclosed for mixing an abrasive such as sand with a flowing fluid such as compressed air. The improved mixing device comprises a body member having a major internal channel being defined along a major axis. The major internal channel extends between a major input and a major output of the major internal channel. The body member includes a minor internal channel defined along a minor axis and extending from a minor input to an intersection with a portion of the major internal channel located between the major input and the major output of the major internal channel. The flowing fluid is directed into the major input whereas the abrasive is directed into the minor input for enabling the abrasive to mix with the flowing fluid within the major internal channel and to discharge from the major output. The minor internal channel is established at an acute angle relative to the major internal channel and extends generally toward the major input of the major internal channel for enabling abrasive erosion of the body member to be distributed over a region of the body member during prolonged use of the mixing device.

13 Claims, 4 Drawing Sheets

MIXING DEVICE

BACKGROUND OF THE INVENTION

1. Field of the Invention

The present invention relates to the mixing of a solid particulate material with a fluid. More particularly the present invention relates to an improved mixing device for mixing an abrasive such as sand with a fluid such as air.

2. Description of Prior Art

The prior art has known various means and methods for mixing a solid particulate material with a flowing fluid. One important aspect of mixing a solid particulate material with a fluid concerns the art of sand blasting wherein an abrasive such as sand is mixed with a flowing fluid such as air. In the prior art sand blasting apparatii, sand from a pressurized vessel is introduced into a stream of flowing high pressure air. The introduction of the sand into the stream of flowing high pressure air is generally accomplished by a mixing device such as a T-fitting. The stream of high pressure air is passed through the T-fitting parallel to the longitudinal dimension of the T-fitting. The sand from the pressurized vessel is introduced into the stream of flowing high pressure air through a side opening in the T-fitting. Since the sand from the pressurized vessel is introduced through the side opening of the T-fitting, the sand must be redirected through an angle of ninety degrees before the sand is flowing in the same direction as the direction of flow as the high pressure air. The redirection of the sand within the T-fitting results in a substantial erosion of the internal channels of the T-fitting and ultimately results in the failure of the T-fitting.

The useful life of the T-fitting in a sand blasting apparatus is critical to the operating efficiency of the sand blasting apparatus. If the useful life of the T-fitting is relatively short, the operating efficiency of the sand blasting apparatus is relatively low since the sand blasting operation must be terminated during the replacement of the T-fitting. Such inefficiency is extremely costly since it not only affects the operating efficiency of the sand blasting apparatus per se, but also affects the operating efficiency of the object being sand blasted. For example, during the sand blasting of a commercial or a military ship, the ship is unavailable for normal commercial or military service resulting in a very substantial cost to the commercial business or the military service.

Therefore, an object of the present invention is to provide an improved mixing device having a long useful life for increasing the operating efficiency of the sand blasting apparatus and consequently the operating efficiency of the object being sand blasted.

Another object of the present invention is to provide an improved mixing device having a novel means for introducing the sand from the pressurized vessel through a side opening of the T-fitting of a sand blasting apparatus.

Another object of the present invention is to provide an improved mixing device having novel means for redirecting the sand from the side opening in the T-fitting to flow in the same direction as the high pressure flowing air.

Another object of the present invention is to provide an improved mixing device having novel means for decreasing the erosion of the internal channels of the T-fitting and upon continued use of the sand blasting apparatus.

Another object of the present invention is to provide an improved mixing device having a novel means for introducing the sand from the pressurized vessel through the side opening of the T-fitting at an acute angle relative to the direction of flow of the high pressure air enabling the erosion of the T-fitting to be distributed over a region of the T-fitting member during prolonged use of the sand blasting apparatus.

Another object of the present invention is to provide an improved mixing device having a novel sacrificial insert within the T-fitting for reducing the possibility of failure of the T-fitting.

Another object of the present invention is to provide an improved mixing device having a novel replaceable sacrificial insert within the T-fitting for enabling the reuse of the same T-fitting.

Another object of the present invention is to provide an improved mixing device which may be used with conventional sand blasting apparatii without modification.

The foregoing has outlined some of the more pertinent objects of the present invention. These objects should be construed to be merely illustrative of some of the more pertinent features and applications of the invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is incorporated in the claims of the present specification with specific embodiments shown in the accompanying drawing. For the purpose of summarizing the present invention, the invention is incorporated into an apparatus and method of an improved mixing device for mixing an abrasive with a flowing fluid, comprising a body member having a major internal channel defined therein with the major internal channel being defined along a major axis. The major internal channel extends between a major input and a major output of the major internal channel. The body member has a minor internal channel defined therein with the minor internal channel being defined along a minor axis. The minor internal channel extends from a minor input to an internal end intersecting with a portion of the major internal channel located between the major input and the major output of the major internal channel. The flowing fluid is directed into the major input of the major internal channel whereas the abrasive is directed into the minor input of the minor internal channel for enabling the abrasive to mix with the flowing fluid within the major internal channel and to discharge from the major output. The minor internal channel is established at an acute angle relative to the major internal channel enabling abrasive erosion of the body member to be distributed over a region of the body member during prolonged use of the mixing device.

The minor internal channel extends generally toward the major input of the major internal channel allowing a portion of the internal end of the minor internal channel proximate the major internal channel to be eroded during prolonged use of the mixing device for redirecting the abrasive flow path.

In a more specific example of the present invention, the body member comprises a metallic T-fitting means with the major internal channel being defined along the major longitudinal internal channel of the T-fitting and with the minor internal channel being defined along a minor internal channel or side opening of the T-fitting. Preferably, the minor internal channel is established at an acute angle relative to the major internal channel by a sacrificial insert disposed in the minor internal channel for directing the abrasive flow path.

In the preferred embodiment of the invention, the body member has a major internal channel defined therein with the major internal channel being defined along a major internal channel. The major internal channel extends between a major input and a major output of the major internal channel. The body member has a minor internal channel defined therein with the minor internal channel being defined along a minor internal channel. The minor internal channel extends from a minor input to an internal end intersecting with a portion of the major internal channel located between the major input and the major output of the major internal channel. A sacrificial insert overlays the major internal channel and the minor internal channel with the sacrificial insert having a metering aperture for establishing the minor internal channel at an acute angle relative to the major internal channel enabling abrasive erosion of the body member to be distributed over a region of the sacrificial insert during prolonged use of the mixing device.

In still a more specific example of the preferred embodiment of the present invention, the sacrificial insert comprises an abrasive resistant polymeric material with the metering aperture extending generally toward the major input of the major internal channel. Accordingly, the internal end of the minor channel of the sacrificial insert coated proximate the major internal channel is eroded during prolonged use of the mixing device for redirecting the abrasive flow path.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESTRUCTION

Figure 1:
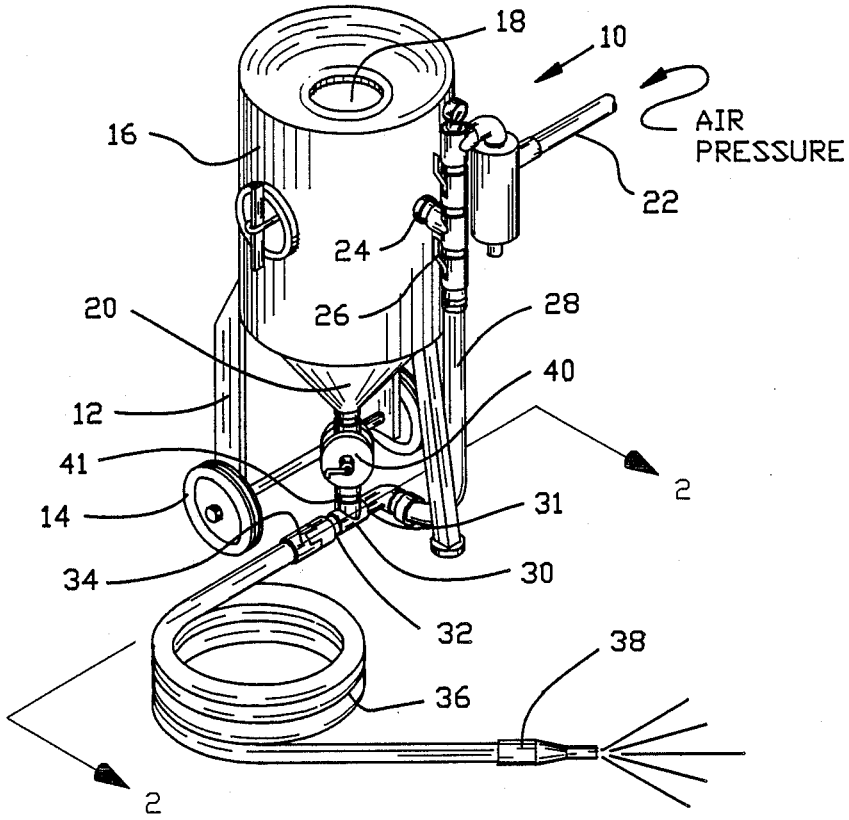
FIG. 1 is an isometric view of a conventional sand blasting device suitable for incorporating the present invention.

FIG. 1 is an isometric view of a conventional sand blasting apparatus 10 comprising a frame 12 mounted on wheels 14 for supporting a vessel 16. The vessel 16 is adapted to receive an abrasive material such as sand. The sand is introduced into the vessel 16 through an opening 18 in the top of the vessel 16 and is discharged from an opening 20 in the bottom of the vessel 16. A source of high pressure air (not shown) is connected to a conduit 22. The high pressured air in conduit 22 is directed through conduit 24 for pressurizing the interior of vessel 16. The high pressure air from conduit 22 is also directed through a valve 26 and a conduit 28 to a mixing device 30. The mixing device 30 is shown as a T-fitting having a longitudinal length and having a first end 31 connected to the conduit 28 for receiving the high pressure air and having a second end 32 connected through a coupling 34 to a flexible hose 36. The flexible hose 36 supports a nozzle 38. The opening 20 in the bottom of vessel 16 is connected through a regulator 40 to a side opening 41 in the T-fitting mixing device 30.

The operation of the sand blasting apparatus should be well known to those skilled in the art. When high pressure air is applied to conduit 22, vessel 16 is pressurized through conduit 24. Concomitantly therewith, the high pressure air flows through conduit 28 to the mixing device 30. The mixing device 30 draws the sand abrasive from the pressurized vessel 16 which sand abrasive flows through the flexible hose 36 to discharge from nozzle 38.

Figure 2:
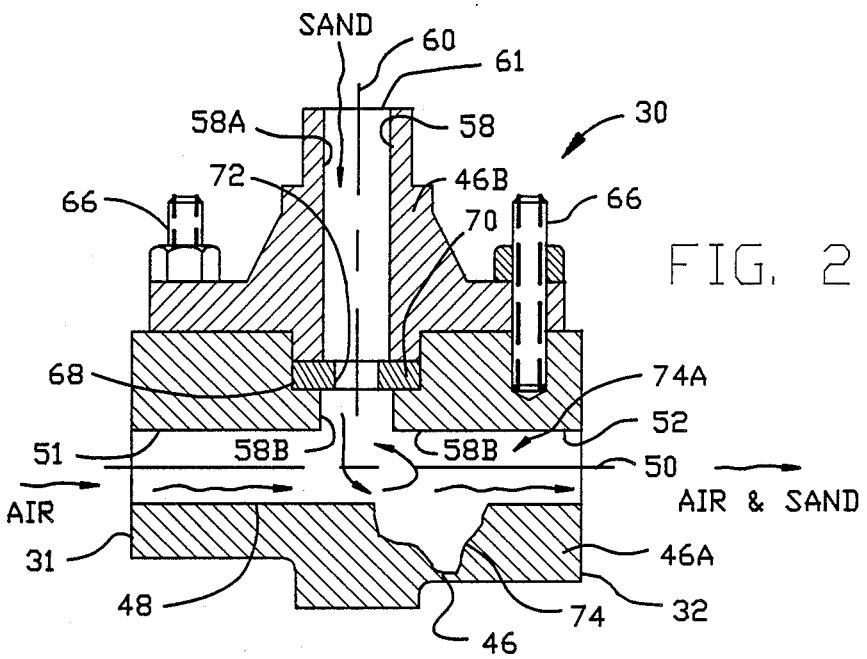
FIG. 2 is an enlarged partial side sectional view along line 2–2 of FIG. 1 of a conventional prior art mixing device for mixing an abrasive with air.

FIG. 2 is an enlarged partial sectional view along line 2–2 of FIG. 1 showing in greater detail the prior art mixing device 30. The mixing device 30 comprises a body member 46 having a lower body portion 46A and an upper body portion 46B. The body member 46 has a major internal channel 48 extending along a major axis 50 between a major input 51 and a major output 52. The major input 51 is in fluid communication with the first end of the mixing device 30 whereas the major output 52 is in fluid communication with the second end 32 of the mixing device 30. The body member 46 also comprises a minor internal channel 58 extending along a minor axis 60 between a minor input 61 and an internal end 62. The minor internal channel 58 has an input portion 58A disposed in the upper body portion 46B and an output portion 58B disposed in the lower body portion 46A. The internal end 62 of the minor internal channel 58 intersects with the major internal channel 48 at a position between the major input 51 and the major output 52. The upper body portion 46B is secured to the lower body portion 46A by threaded fasteners 66. A recess 68 within the lower body portion 46A receives a metering insert 70 having a metering aperture 72 for regulating the flow of the sand from the minor channel 58 into the major channel 48. A change in the aperture size of the metering aperture 72 causes a corresponding change in the amount of the sand that is mixed with the flowing high pressure air.

In operation, the high pressure air enters the major input 51 and flows through the major internal channel 48 to exit from the major output 52 as shown by the arrows. The sand abrasive flows through minor internal channel 58 from minor input 61 to the internal end 62 to mix with the flowing high pressure air within the major internal channel 48. The mixing of the sand with the flowing high pressure air within the major internal channel 48 causes a turbulence which erodes the body member 46 as indicated by the erosion 74. Erosion likewise occurs on the sidewalls 74A of the major internal channel 48 due to the turbulent flow of the abrasive sand material. The turbulent flow of the abrasive sand material is caused in part by the required redirection of the sand material since the sand material enters along the minor axis 60 which is normal to the major axis 50. Accordingly, the abrasive sand material must be redirected through an angle of 90 degrees before the sand is flowing in the same direction of flow as the high pressure air.

The erosion of the body member 46 substantially reduces the useful life of the mixing device 30 and generally results in a fracture of the body member 46 at 74 or 74A. A fracture in the body member 46 causes a pressure leakage thus requiring replacement of the body member 46. The replacement of the mixing device 30 substantially reduces the efficiency of the sand blasting apparatus 10 since the sand blasting operation takes a substantially greater time to accomplish due to the replacement of the mixing device 30. Furthermore, a fractured mixing device 30 must be totally replaced which further adds to the cost of the operation of the sand blasting apparatus 10. The problems associated with the prior art mixing device 30 have been eliminated by the improved mixing device 130 shown in FIGS. 3–5 and the mixing device 230 shown in FIGS. 6–8.

Figure 3:
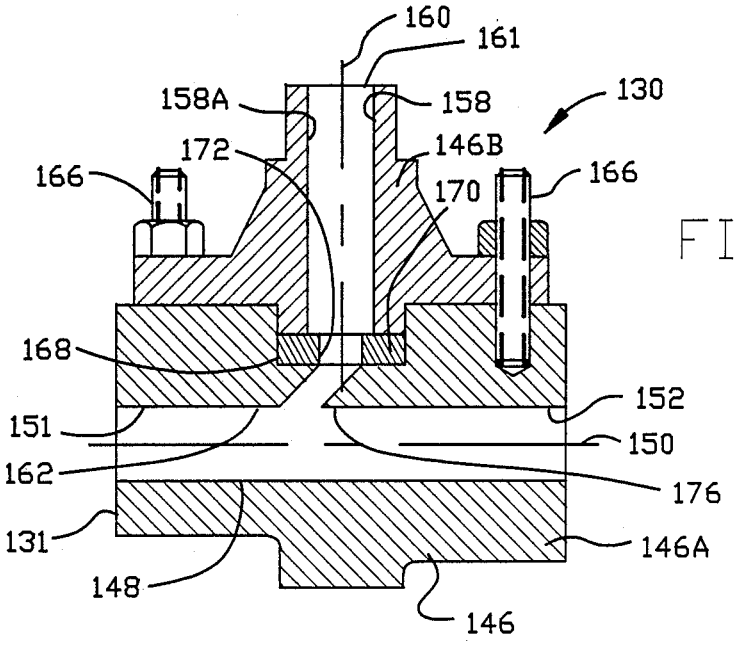
FIG. 3 is an enlarged side sectional view of a first embodiment of an improved mixing device of the present invention for mixing an abrasive with air suitable for use in the conventional sand blasting device of FIG. 1.

FIG. 3 is an enlarged side sectional view of a first embodiment of a improved mixing device 130 comprising a body member 14 having a lower body portion 146A and an upper body portion 146B. The body member 146 has a major internal channel 148 extending along a major axis 150 between a major input 151 and a major output 152. The major input 151 is in fluid communication with the first end 131 of the mixing device 130 whereas the major output 152 is in fluid communication with the second end 132 of the mixing device 130. The first end 131 is connected to the conduit 28 of the sand blasting apparatus 10 of FIG. 1 for receiving the high pressure air. In a similar manner, the second end 132 is connected through the coupling 34 to the flexible hose 36 of FIG. 1.

The body member 146 also comprises a minor internal channel 158 extending between a minor input 161 and an internal end 162. The minor input 161 receives the sand abrasive material from the vessel 16. The minor internal channel 158 has an input portion 158A disposed in the upper body portion 146B and an output portion 158B disposed in the lower body portion 146A. The upper body portion 146B is secured to the lower body portion 146A by threaded fasteners 166. A recess 168 within the lower body portion 146A receives a metering insert 170 having a metering aperture 172 for regulating the flow of the sand from the minor channel 158 into the major channel 148. A change in the aperture size of the metering aperture 172 causes a corresponding change in the amount of the sand that is mixed with the flowing high pressure air.

The output portion 158B of the minor internal channel 158 extends along a minor axis 160 to the internal end 162 which intersects with the major internal channel 148. In contrast to the prior art mixing device 30 shown in FIG. 2, the output portion 158B of the minor internal channel 158 is established at an acute angle relative to the major internal channel 148 thereby defining a sacrificial portion 176 adjacent the major internal channel 148. In this embodiment, the output portion 158B of the minor internal channel 158 is established at a forty five (45%) degree angle relative to the major internal channel 148 but it should be understood that other angles may be utilized within the scope of the present invention. The output portion 158B of the minor internal channel 158 is established at the acute angle relative to the major internal channel 148 such that the output portion 158B of the minor internal channel 158 extends generally toward the major input 151 of the major internal channel 148. As the sacrificial portion 176 adjacent the major internal channel 148 erodes, the abrasive erosion of the body member 148 is distributed over a wider region of the major internal channel 148 of the body member 148.

FIG. 3 illustrates the output portion 158B of the minor internal channel 158 and the sacrificial portion 176 adjacent the major internal channel 148 prior to the sand blasting operation. The acute angle of the output portion 158B of the minor internal channel 158 relative to the major internal channel 148 requires the abrasive sand material to be redirected through an angle of 135 degrees (135%) before the sand is flowing in the same direction of flow as the high pressure air.

Figure 4:
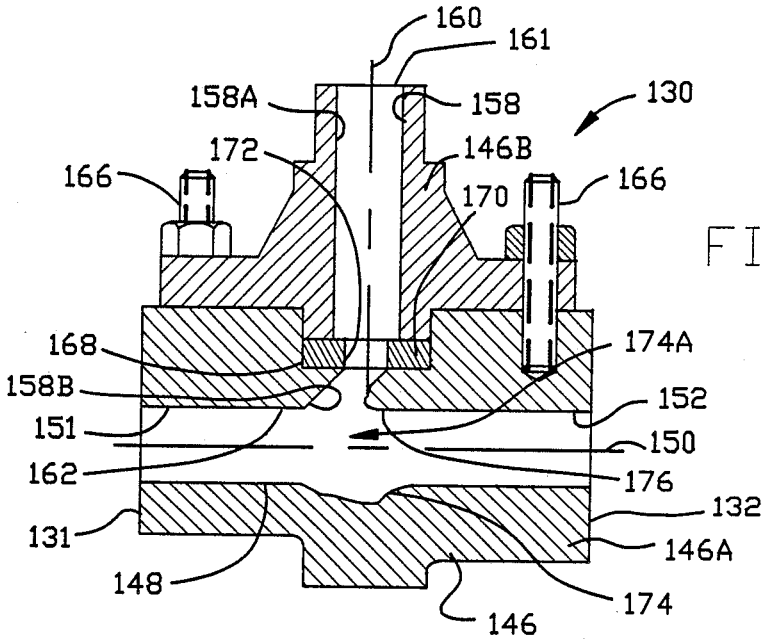
FIG. 4 is a side sectional view of the improved mixing device of FIG. 3 illustrating moderate erosion of the abrasive flow path.

FIG. 4 illustrates the output portion 158B of the minor internal channel 158 and the sacrificial portion 176 adjacent the major internal channel 148 after moderate use of the sand blasting apparatus 10. As it can be clearly seen from FIG. 4, the mixing of the sand with the flowing high pressure air within the major internal channel 148 eroded the major internal channel 148 as indicated by the erosion 174 and 174A. However, the erosion 174 and 174A of the major internal channel 148 has occurred upstream relative to the erosion 74 and 74A of the major internal channel 48 of the prior art device shown in FIG. 2. The turbulent flow of the abrasive sand material has also eroded the sacrificial portion 176. As the sacrificial portion 176 continues to erode, the effective angle of the output portion of the output portion 158B of the minor internal channel 158 relative to the major internal channel 148 continues to decrease thereby directing the flow of the abrasive sand material at more downstream position within the the major internal channel 148.

Figure 5:
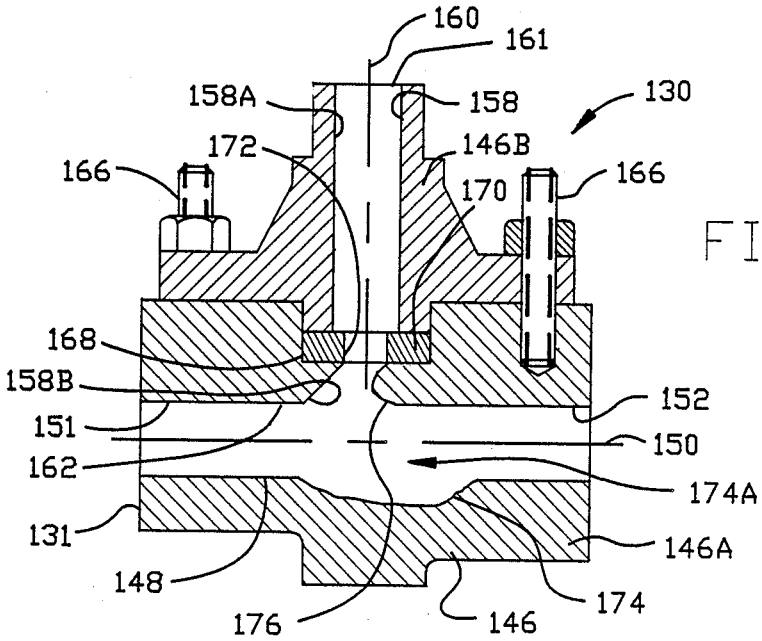
FIG. 5 is a side sectional view of the improved mixing device of FIG. 3 illustrating substantial erosion of the abrasive flow path.

FIG. 5 illustrates the output portion 158B of the minor internal channel 158 and the sacrificial portion 176 adjacent the major internal channel 148 after substantial use of the sand blasting apparatus 10. The turbulent flow of the abrasive sand material has further eroded the sacrificial portion 176 to further reduce the effective angle of the output portion 158B of the minor internal channel 158 relative to the major internal channel 148. The mixing of the sand with the flowing high pressure air within the major internal channel 148 has eroded more downstream portions of the major internal channel 148 as indicated by the erosion 174 and 174A. Continued erosion of the sacrificial portion 176 further reduces the effective angle of the output portion 158B of the minor internal channel 158 relative to the major internal channel 148 causing more downstream erosion within the major internal channel 148. The erosion of the body member 146 in the present invention occurs over a larger surface area of the major internal channel 148 of the body member 146 relative to the prior art device to substantially reduce the erosion at a particular position in the major internal channel 148 of the body member 146 to greatly reduce the possibility of a fracture of the mixing device 130 at a specific position within the major internal channel 148.

Figure 6:
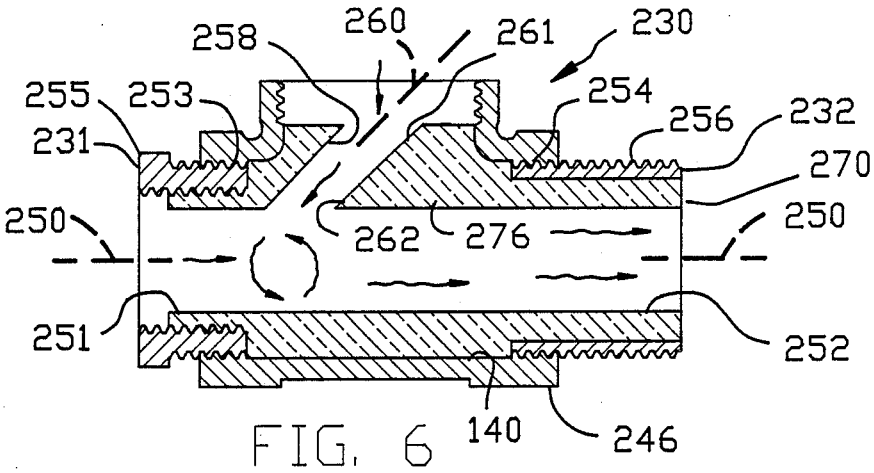
FIG. 6 is an enlarged side sectional view of a second embodiment of an improved mixing device of the present invention for mixing an abrasive with air suitable for use in the conventional sand blasting device of FIG. 1.

FIG. 6 is an enlarged side sectional view of a second embodiment of a improved mixing device 230 comprising a body member 246 including an insert 270 constructed of an abrasion resistant polymeric material such as polyurethane. The insert 270 may be cast or injection molded into the body member 246 for defining the internal channels within the body member 246. The insert 270 has a major internal channel 248 extending along a major axis 250 between a major input 251 and a major output 252. In this embodiment, the body member 246 has a threaded fasteners 253 and 254 for connection to a first and a second coupling 255 and 256 thereby defining a first and a second end 231 and 232. The major input 251 is in fluid communication with the first end 231 of the mixing device 230 whereas the major output 252 is in fluid communication with the second end 232 of the mixing device 230. The first end 231 is connected to conduit 28 of the sand blasting apparatus 10 of FIG. 1 for receiving the high pressure air. In a similar manner, the second end 232 is connected through the coupling 34 to the flexible hose 36 of FIG. 1.

The insert 270 of the body member 246 also defines a minor internal channel 258 extending along a minor axis 260 between a minor input 261 and an internal end 262 which intersects with the major internal channel 248 at a position between the major input 251 and the major output 252. In contrast to the prior art mixing device shown in FIG. 2, the minor internal channel 258 is established at an acute angle relative to the major internal channel 248 to define a sacrificial portion 276. In this embodiment, the minor internal channel 258 is established at a forty five (45%) degree angle relative to the major internal channel 248 but it should be understood that other angles may be utilized within the scope of the present invention. The minor internal channel 258 is established at the acute angle relative to the major internal channel 248 such that the minor internal channel 258 extends generally toward the major input 251 of the major internal channel 248. In a similar manner to the first embodiment shown in FIGS. 3-5, the erosion of the sacrificial portion 276 adjacent the major internal channel 248 distributes the abrasive erosion of the body member 248 over a wider region of the major internal channel 248 of the body member 246.

FIG. 6 illustrates the output portion 258B of the minor internal channel 258 and the sacrificial portion 276 adjacent the major internal channel 248 prior to the sand blasting operation. The acute angle of the minor internal channel 258 relative to the major internal channel 248 requires the abrasive sand material to be redirected through an angle of 135 degrees (135%) before the sand is flowing in the same direction of flow as the high pressure air.

Figure 7:
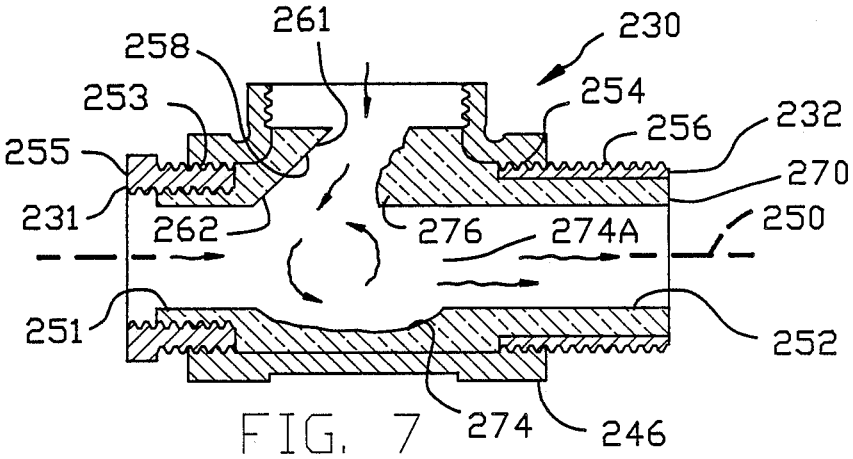
FIG. 7 is a side sectional view of the improved mixing device of FIG. 6 illustrating moderate sacrificial erosion of the abrasive flow path.

FIG. 7 illustrates the output portion 258B of the minor internal channel 258 and the sacrificial portion 276 adjacent the major internal channel 248 after moderate use of the sand blasting apparatus 10. As it can be clearly seen from FIG. 7, the mixing of the sand with the flowing high pressure air within the major internal channel 248 eroded the major internal channel 248 as indicated by the erosion 274 and 274A. However, the erosion 274 and 274A of the major internal channel 248 has occurred upstream relative to the erosion 74 and 74A of the major internal channel 48 of the prior art device shown in FIG. 2. The turbulent flow of the abrasive sand material has also eroded the sacrificial portion 276. As the sacrificial portion 276 continues to erode, the effective angle of the output portion 258B of the minor internal channel 258 relative to the major internal channel 248 continues to decrease thereby directing the flow of the abrasive sand material at more downstream position within the major internal channel 248.

Figure 8:
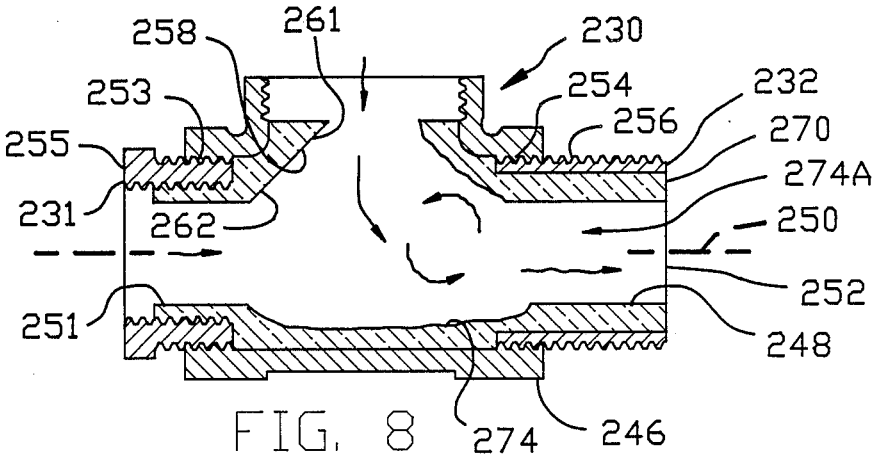
FIG. 8 is a side sectional view of the improved mixing device of FIG. 6 illustrating substantial sacrificial erosion of the abrasive flow path.

FIG. 8 illustrates the minor internal channel 258 and the sacrificial portion 276 adjacent the major internal channel 248 after substantial use of the sand blasting apparatus 10. The turbulent flow of the abrasive sand material has further eroded the sacrificial portion 276 to further reduce the effective angle of the minor internal channel 258 relative to the major internal channel 248. The mixing of the sand with the flowing high pressure air within the major internal channel 248 has eroded more downstream portions of the major internal channel 248 as indicated by the erosion 274 and 274A. Continued erosion of the sacrificial portion 276 further reduces the effective angle of the minor internal channel 258 relative to the major internal channel 248 causing more downstream erosion within the major internal channel 248.

In the present invention, the erosion of the body member 246 occurs over a larger surface area of the major internal channel of the body member relative to the prior art device. Accordingly, the present invention substantially reduces extreme erosion at a particular position in the major internal channel of the body member by distributing the erosion over a wider region of surface area of the major internal channel of the body member relative to the prior art device. The distribution of the erosion over a wider region of surface area of the major internal channel greatly reduces the possibility of a fracture of the mixing device at a specific position within the major internal channel. Additionally, the useful life of the mixing device is substantially extended.

The present disclosure includes that contained in the appended claims as well as that of the foregoing description Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved mixing device for mixing an abrasive with a flowing fluid, comprising:

a body member having a major internal channel defined therein:

said major internal channel extending between a major input and a major output of said major internal channel;

said body member having a minor internal channel defined therein;

said minor internal channel extending from a minor input to an internal end intersecting with a portion of said major internal channel located between said major input and said major output of said major internal channel;

means for directing the flowing fluid into said major input of said major internal channel;

means for directing the abrasive into said minor input of said minor internal channel for enabling the abrasive to mix with the flowing fluid with said major internal channel and to discharge from said major output; and means establishing said minor internal channel at an acute angle relative to said major internal channel with said minor internal channel extending generally toward said major input of said major internal channel for enabling abrasive erosion of said body member to be distributed over a region of said body member during prolonged use of the mixing device.

2. An improved mixing device as set forth in claim 1, wherein said body member comprises a metallic T-fitting; and said major internal channel being defined along a major longitudinally extending internal channel of said T-fitting and said minor internal channel being defined within a minor internal channel of a side opening of said T-fitting.

3. An improved mixing device a set forth in claim 1, wherein said body member comprises a metallic T-fitting means;

said means for directing the flowing fluid into said major input of said major internal channel comprises fastening means connected to said T-fitting, and said means for directing the abrasive into said minor input of said minor internal channel comprises fastening means connected to a side opening of said T-fitting.

4. An improved mixing device as set forth in claim 1, wherein said means establishing said minor internal channel at an acute angle relative to said major internal channel includes a sacrificial insert disposed in said minor internal channel for directing the abrasive flow path.

5. An improved mixing device as set forth in claim 4, wherein said body member comprises a metallic material; and said sacrificial insert comprises an abrasive resistant polymeric material.

6. An improved mixing device as set forth in claim 1, wherein said means establishing said minor internal channel at an acute angle relative to said major internal channel includes a sacrificial insert disposed in said minor internal channel; and said sacrificial insert comprises an abrasive resistant polymeric material which when eroded will redirect the abrasive flow path to prolong the use of the mixing device.

7. An improved mixing device as set forth in claim 1, wherein a portion of said internal end of said minor internal channel proximate said major internal channel is eroded during prolonged use of the mixing device for redirecting the abrasive flow path.

8. An improved mixing device as set forth in claim 1, wherein said minor input of said minor internal channel includes a metering input for metering the flow of the abrasive into said major internal channel.

9. An improved mixing device as set forth in claim 1, wherein said means establishing said minor internal channel at an acute angle relative to said major internal channel includes a sacrificial insert disposed in said minor internal channel and said major internal channel to prohibit the abrasive from contacting said body member; and said minor internal channel proximate said major internal channel being eroded during prolonged use of the mixing device for redirecting the abrasive flow path over the duration of prolonged use of the mixing device.

10. An improved mixing device for mixing an abrasive with a flowing fluid, comprising:

a body member having a major internal channel defined therein;

said major internal channel extending between a major input and a major output of said major internal channel;

said body member having a minor internal channel defined therein;

said minor internal channel extending from a minor input to an internal end intersecting with a portion of said major internal channel located between said major input and said major output of said major internal channel;

a sacrificial insert overlying said major internal channel and said minor internal channel;

means for directing the flowing fluid into said major input of said major internal channel;

means for directing the abrasive into said minor input of said minor internal channel for enabling the abrasive to mix with the flowing fluid with said major internal channel and to discharge from said major output; and said sacrificial insert having a metering aperture for establishing said minor internal channel at an acute angle relative to said major internal channel with said minor internal channel extending generally toward said major input of said major internal channel for enabling abrasive erosion of said body member to be distributed over a region of said sacrificial insert during prolonged use of the mixing device.

11. An improved mixing device as set forth in claim 10, wherein said body member comprises a metallic T-fitting; and said major internal channel being defined along a major longitudinally extending internal channel of said T-fitting and said minor internal channel being defined along said metering aperture of said sacrificial insert disposed within a side opening of said T-fitting.

12. An improved mixing device as set forth in claim 10, wherein said said sacrificial insert comprises an abrasive resistant polymeric material.

13. An improved mixing device as set forth in claim 10, wherein a portion of said internal end of said minor channel of said sacrificial insert proximate said major internal channel is eroded during prolonged use of the mixing device for redirecting the abrasive flow path.

* * * * *

UNITED STATES PATENT AND TRADEMARK OFFICE

CERTIFICATE OF CORRECTION

PATENT NO. : 4,895,451

DATED : January 23, 1990

INVENTOR(S) : Wayne B. Hockett

It is certified that error appears in the above-identified patent and that said Letters Patent is hereby corrected as shown below:

On the title page:
In the title block [21] preceding Abstract, delete "215,001" and insert therefor --215,004--.

Column 3, line 40, delete "coated" and insert therefor --located--.

Column 4, line 26, delete "DESTRUCTION" and insert therefor --DESCRIPTION--.

Column 4, line 65, after "end" insert --31--.

Column 5, line 52, after "the" insert --improved--.

Column 5, line 56, delete "14" and insert therefor --146--.

Column 6, line 39, delete "148" (second occurrence) and insert therefor --146--.

Signed and Sealed this

Twenty-fifth Day of December, 1990

*Attest:*

*Attesting Officer*

HARRY F. MANBECK, JR.

*Commissioner of Patents and Trademarks*